US005330372A

United States Patent [19]

Pope et al.

[11] Patent Number: 5,330,372

[45] Date of Patent: Jul. 19, 1994

[54] HIGH-DENSITY CONNECTOR

[75] Inventors: Richard A. Pope; Clyde W. Boling, both of Austin; David A. Bates, Cedar Park, all of Tex.

[73] Assignee: Minnesota Mining and Manufacturing Company, St. Paul, Minn.

[21] Appl. No.: 61,212

[22] Filed: May 13, 1993

[51] Int. Cl.[5] ..... H01R 13/00

[52] U.S. Cl. ..... 439/692

[58] Field of Search ..... 439/692-697, 439/699

[56] References Cited

U.S. PATENT DOCUMENTS

| | | | |
|---|---|---|---|
| 2,356,752 | 8/1944 | Deysher | 439/699 |
| 2,755,452 | 7/1956 | Rogie | 439/699 |
| 3,337,838 | 8/1967 | Damiano et al. | 339/217 |
| 3,444,506 | 5/1969 | Wedekind | 339/99 |
| 4,572,604 | 2/1986 | Ammon et al. | 339/176 |
| 4,655,526 | 4/1987 | Shaffer | 339/74 |
| 4,897,055 | 1/1990 | Jurista et al. | 439/924 |
| 4,975,066 | 12/1990 | Sucheski et al. | 439/63 |
| 4,997,376 | 3/1991 | Buck et al. | 439/59 |

*Primary Examiner*—Joseph H. McGlynn

*Attorney, Agent, or Firm*—Gary L. Griswold; Walter N. Kirn; David W. Anderson

[57] ABSTRACT

A projection-type male connector component includes a buttress of insulative polymeric material surrounded by a number of electrically conductive contacts electrically isolated from each other. The male component is designed to mate with an equal number of female cantilever beam contacts. The buttress is provided with a tapered end and the male contacts are bent over this tapered end so that the female contacts touch the male contacts when the male and female contacts are mated rather than the insulative material from which the buttress is made. In this way, excessive wear of the female contacts is avoided.

2 Claims, 3 Drawing Sheets

HIGH-DENSITY CONNECTOR

FIELD OF THE INVENTION

The present invention relates generally to electrical interconnect systems and particularly to electrical connector components of such interconnect systems.

BACKGROUND OF THE INVENTION

Interconnect systems refers generally to the connection of electrical or electronic devices and includes all the components necessary for connection, such as cabling, connectors for attaching cable to circuit boards or another cable, or connectors for directly attaching one component such as a circuit board to another. The present invention concerns itself particularly with projection type connector components wherein a conductive pin, or more typically, an array of a number of conductive pins, are mated with a number of similarly arrayed conductive sockets.

Such connector components may be mated and separated a large number of times and are usually employed to connect electrical cable to a device or another cable or to connect electronic devices, such as circuit boards, directly to one another. It is desirable that such connector components be as small as possible, both to conserve space and for performance reasons. The smaller the connector components the shorter the conductive path within the connector, which generally translates into the ability to transmit electrical signals at higher speeds than a connector having a larger size and longer conductive paths. Small size, however, creates its own problems in terms of the strength of the very small components, the ability to assemble such components and the fact that small, thin components will wear to a point of failure very quickly if care is not taken in their design.

One particular connector design of which applicant is aware achieves small size and high density in a projection-type connector by providing a male connector component having a square projection of electrically insulative material surrounded by four metal contacts in electrical isolation from one another. The four male contacts mate with four cantilever beam contacts arranged to form a square female socket. Each of the male contacts engages one of the beam female contacts to complete an electrical circuit, and thus four connections are achieved at a single projection.

A problem that has been recognized with the connector just described is that the female contacts first touch and slide along the surface of the insulative material forming the projection when the male connector component is mated to the female connector component. The insulative material of the projection is typically rough and abrasive, and thus the sliding motion of the female contacts relative to this material causes rapid wear and early failure of the female contact.

SUMMARY OF THE INVENTION

The present invention improves upon the existing male connector component by providing a substrate of electrically insulative material, a buttress extending from the substrate and having a plurality of sides and a tapered tip, a number of electrical contacts supported by the buttress and spaced around the buttress in electrical isolation from each other, wherein each of the contacts includes a body portion having a longitudinal axis substantially parallel to the extension of the buttress from the substrate, the body portion being in contact with the buttress sides, and an end portion bent to overlie the tapered tip of the buttress. By forming the contact over the tapered tip of the buttress, the mating female contact first touches the male contact rather than the material of the buttress and thus wear of the female contact is reduced.

The male contact overlying the buttress preferably tapers both in width and thickness so that the male contact can extend the maximum distance along the tapered tip of the buttress, and thus be as large as possible, without contacting another male contact. The male contact is also preferably molded into the buttress such that a surface of the contact forms a surface of the buttress and the male contact is preferably trapezoidal in cross-section with a shorter side forming the surface of the buttress and a longer side parallel to the shorter side being embedded within the insulative material forming the buttress. The ends of the shorter and longer sides are connected by sloping sides so that the material of the buttress flows around the male contacts and prevents relative movement between the contact and the buttress.

BRIEF DESCRIPTION OF THE DRAWINGS

The present invention will be more particularly described with respect to the accompanying drawings, wherein like numbers refer to like parts in the several views, and wherein.

DESCRIPTION OF THE PREFERRED EMBODIMENT

Figure 1:
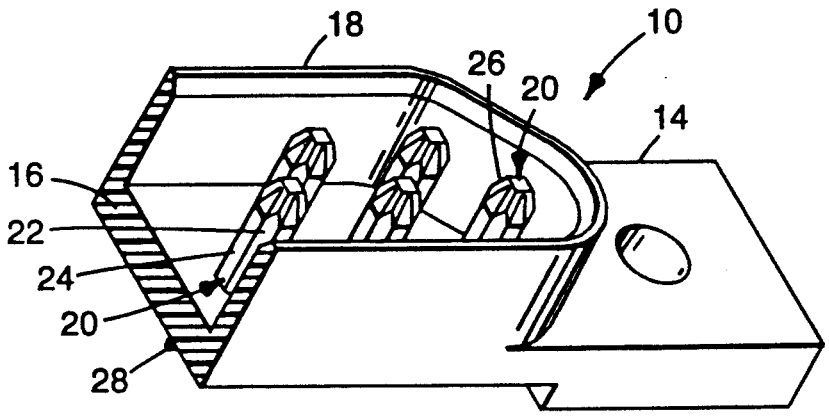
FIG. 1 is a perspective view of a male connector component according to the present invention.
Figure 2:
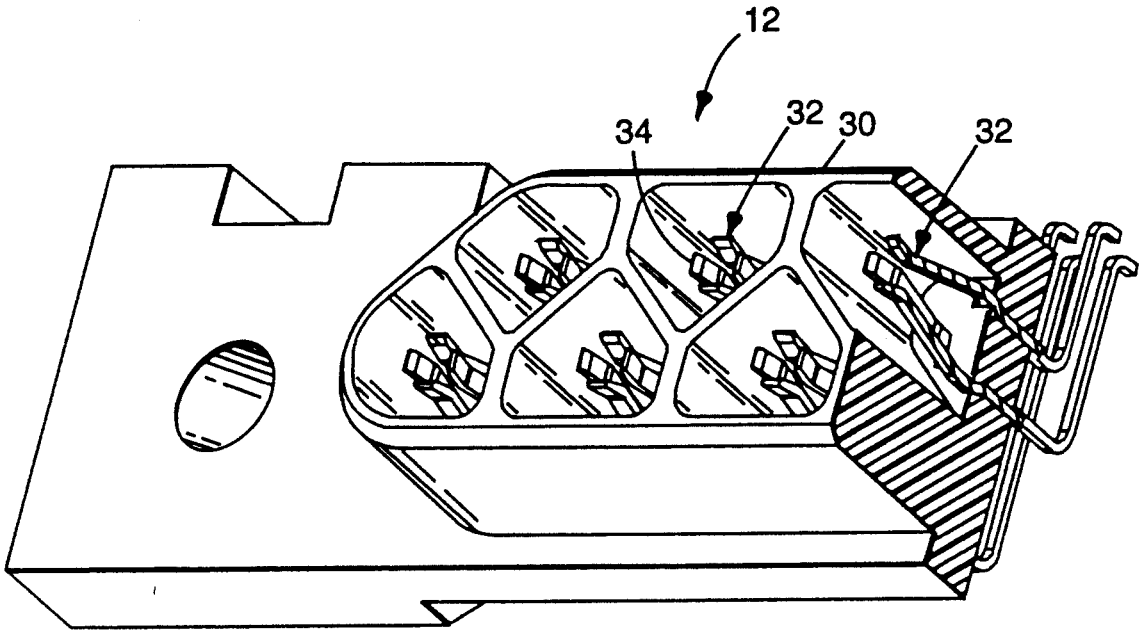
FIG. 2 is a perspective view of a female connector component adapted to mate with the connector component of FIG. 1.

FIG. 1 illustrates a male connector component, generally indicated as 10, which is designed to mate with a female connector component, generally indicated as 12 in FIG. 2. The male connector component 10 includes a body 14 which may be formed by any process such as molding or machining, but which is preferably molded of an electrically insulating material forming a substrate 16 and a wall 18 surrounding a number of projection type contact assemblies 20. The contact assemblies include a central, insulative buttress 22 of electrically insulative material surrounded by four electrically conductive contacts 24.

The buttresses 22 are preferably molded as an integral part of the component body 14, but may be constructed separately, either by molding or machining or similar process, and later attached to the body 14 by any suitable process such as adhesive joining or welding. The material used to form the connector component body 14 and the buttresses 22 may be any conventionally used electrically insulative polymeric material, but preferably is a liquid crystal polymer, and more particularly is a liquid crystal polymer manufactured by Hoescht Celanese and identified as Vectra. The electrically conductive contacts 24 may be formed of beryllium copper, phosphor bronze, brass, tin, gold, palladium, any suitable ally of the foregoing, or any other suitable conductive material. A suitable material is one which exhibits sufficient conductivity to usefully transmit electrical signals and wear and strength characteristics which allow it to survive a desired number of assemblies to and separations from the female connector component 12. Preferred materials are beryllium copper, phosphor bronze, brass or another copper alloy plated with tin, gold, palladium or a combination of two or more of the plating materials.

Figure 3:
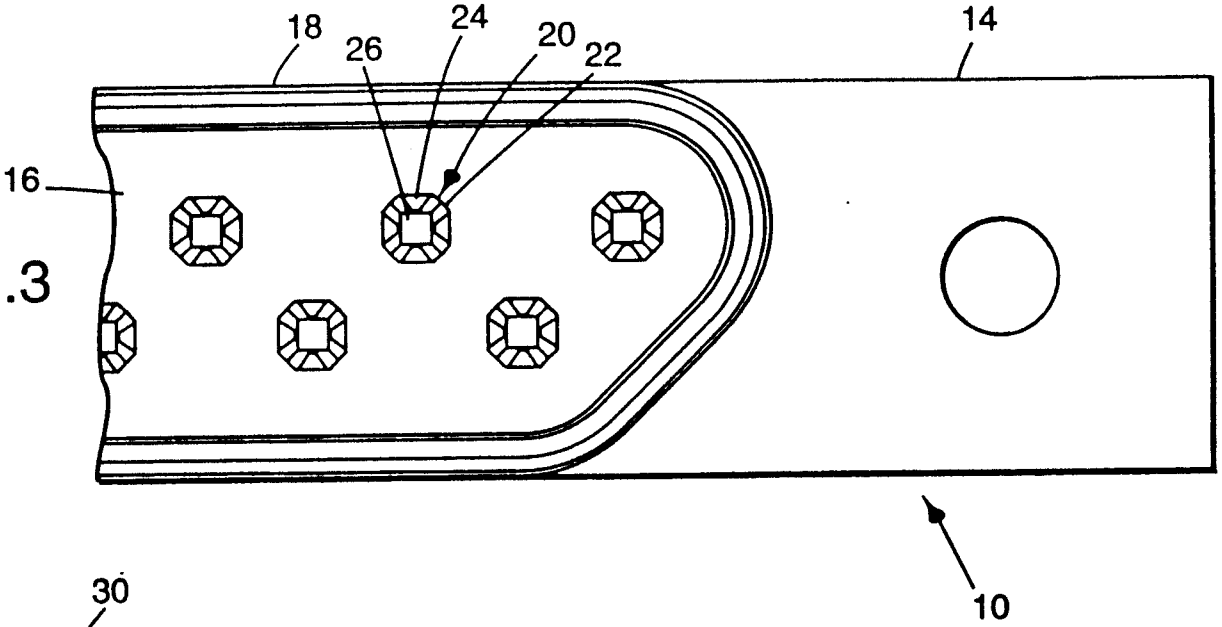
FIG. 3 is a front elevational view of the connector component of FIG. 1.

As is best seen in FIGS. 1 and 3, the buttress 22 and contact 24 assemblies are octagonal in cross-section where the buttresses 22 join to the substrate 16 and extend perpendicularly and upwardly from the substrate to a point where the sides slope inwardly to form a tapered tip 26 which is quadrilateral in cross-section. The tapered tip 26 is truncated short of forming a point.

The contacts 24 are four in number and are disposed to overlie alternate faces of the octagonal portion of the buttress 22. At the location where the buttress 22 tapers inwardly, the contacts 24 bend to conform to the slope of the taper. The contacts 24 extend through the substrate 16 of the connector component body 14 to form terminal ends 28 as may be best seen in FIGS. 5 and 7. The terminal ends 28 afford attachment of the contacts 24 to the conductors of cables or electronic devices such as circuit boards. The terminal ends 28 may be of any shape which is suitable and necessary to enable connection to a desired device.

Figure 8:
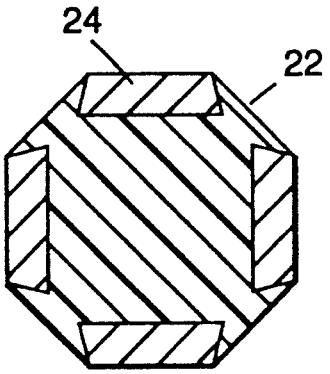
FIG. 8 is a cross-sectional view of one of the contact structures of the connector component of FIG. 1.

The contacts 24 may be inserted through holes in the substrate 16 and simply overlie the buttresses 22, but are preferably molded as an integral part of the connector component 10 as the body 14 of the component 10 and the buttresses 22 are molded simultaneously. It is also preferred, although not necessary, that the contacts 24 be embedded in the buttresses 22 so that the outer surface of each contact 24 forms one of the octagonal sides of the buttress 22. As seen in FIG. 8, the contacts 24 preferably have a trapezoidal cross-section which allows the material of the buttress 22 to flow behind the tapered sides of the trapezoidal shape during molding to lock the contact 24 to the buttress 22 and prevent movement of the contacts 24 away from the buttresses 22.

The contacts 24 are preferably tapered in the transverse direction, as best seen in FIGS. 1 and 3, so that the bent tips of the contacts 24 can extend more fully toward the end of the buttress 22 without interfering with each other. For the same reason, the bent tips are preferably coined so that the ends taper gradually in thickness from the junction of its straight portion to its end. The thickness taper is best seen in FIGS. 5 and 6 and preferably is such that the end is one-half the thickness of the remainder of the contact 24.

Figure 4:
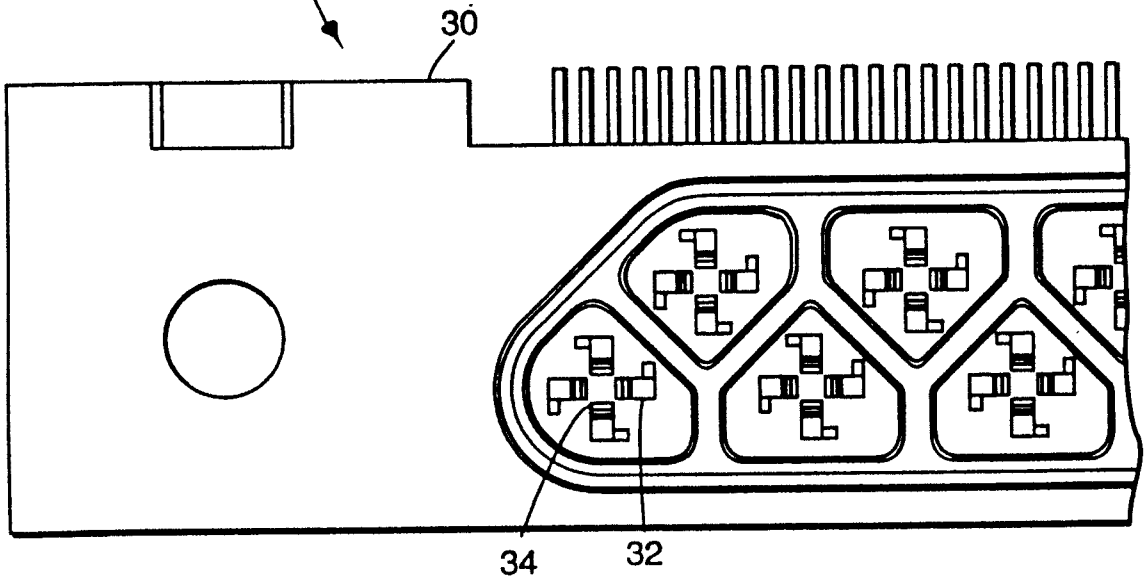
FIG. 4 is a front elevational view of the connector component of FIG. 2.

The female connector component 12 is best seen in FIGS. 2 and 4 and is formed of the molded body 30 and four contacts 32 arrayed to correspond to the position of the four contacts 24 of the male connector component 10 when the male and female connector components 10 and 12 are mated. The contacts 32 are cantilever beams extending from the female connector component 12 and are formed with bent ends 34 to prevent gouging of the male contacts 24 when the two are mated. The contacts 32 are preferably manufactured of the same materials as the male contacts 24, and are preferably molded in place as an integral part of the female connector component 12. The preferred materials for the female connector component 12 correspond to the preferred materials for the male connector component 10.

Figure 5:
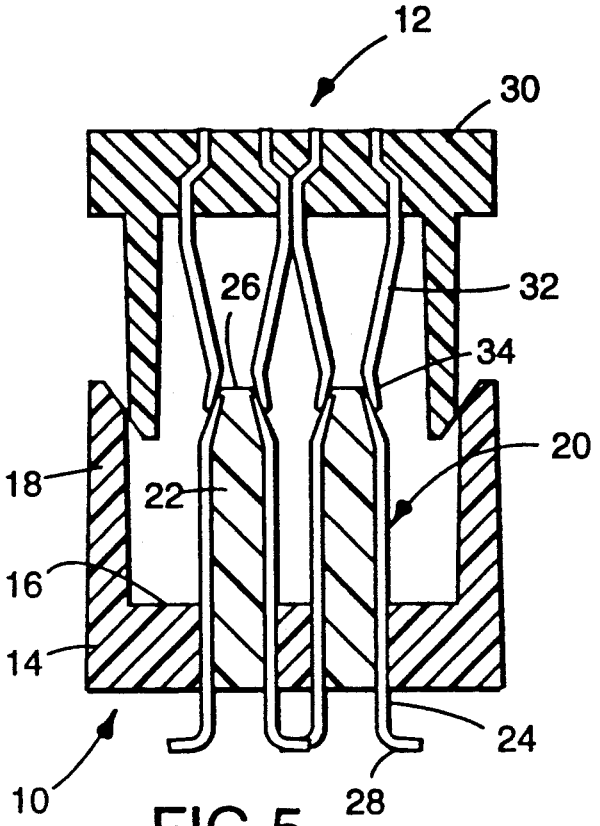
FIG. 5 is a schematic, cross-sectional view of the connector components at initial contact.
Figure 6:
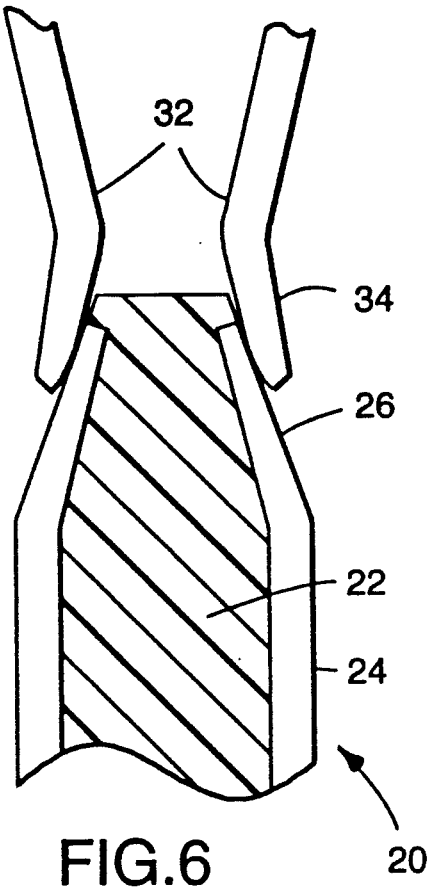
FIG. 6 is an enlarged, cross-sectional view of a portion of FIG. 5.
Figure 7:
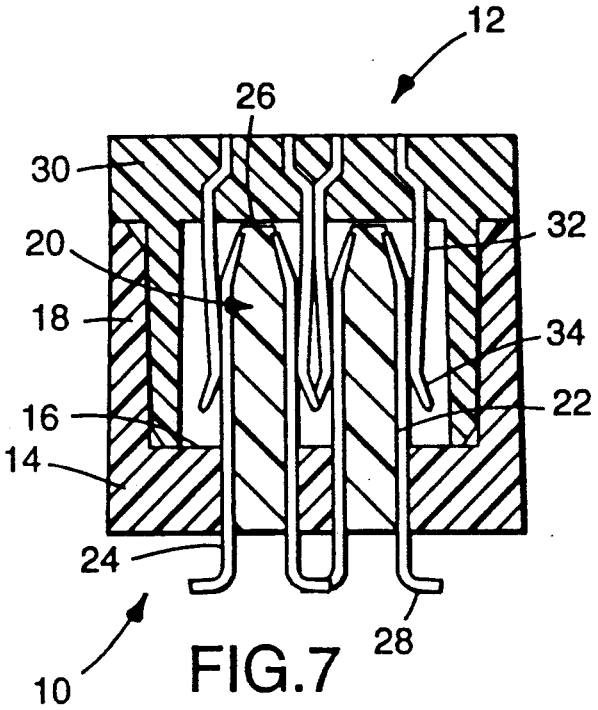
FIG. 7 is a schematic, cross-sectional view from the perspective of FIG 5, with the connector components fully mated.

The reason for providing the tapered, bent tips of the male contacts 24 which overlie the tapered tip 26 of the buttresses 22 is illustrated in FIGS. 5 and 6. As the two connector components 10 and 12 approach each other for mating, the first contact is between the ends of the female contacts 32 and the male contacts 24. If the bent end of the male contacts 24 did not exist, the female contacts 32 would first touch the insulative polymeric material of the buttress 22. Eventual full mating of the contacts 24 and 32, as shown in FIG. 7, would happen even without the bent portion of the male contacts 24 because the tapered tip 26 of the buttress would cause separation of the female contacts 32 and contact with the male contacts 24 as the components 10 and 12 are pushed together. However, the insulative material from which the buttresses 22 are formed is very abrasive and would quickly erode any plating on the female contacts 32 and eventually the base material. The bent tips of the male contacts 24 are provided so that initial contact is between the contacts 24 and 32 only, rather than between the contact 32 and the polymeric material comprising the buttresses 22.

The present invention has been described with respect to only a single embodiment. However, many variations will be apparent to those skilled in the art. For example, the number of contacts may be any number and the shape of the buttress need not be octagonal. Also, less than all of the available sides of the buttress may have contacts associated with them. The contacts may be formed with curved rather than flat surfaces as shown, and the curvature may be in the transverse or longitudinal direction, or both.

We claim:

1. A male connector component comprising:

an electrically insulative substrate having a substantially flat surface;

a buttress including an electrically insulative portion and electrically conductive portions extending substantially perpendicularly from said flat surface of said substrate, said buttress having an octagonal cross-section where said buttress meets said substrate and including a tapered tip having a quadrilateral cross-section;

four electrically conductive contacts forming said conductive portions of said buttress and inset into said insulative portion of said buttress and electrically insulated from each other, said contacts each having a substantially flat surface forming one of the surfaces of said buttress and a bent tip tapering in both width and thickness and inset into one of said buttress tip quadrilateral surfaces such that a surface of said bent tip of said contact is substantially coplanar with said one quadrilateral surface.

2. A male connector component according to claim 1 wherein each of said contacts have a substantially trapezoidal cross-section defined by a shorter side forming a surface of said buttress, a longer side substantially parallel to said shorter side and inset into said moldable material, and sloping sides connecting the ends of said shorter and said longer sides.

* * * * *